US011368778B2

(12) United States Patent
Franzén

(10) Patent No.: US 11,368,778 B2
(45) Date of Patent: Jun. 21, 2022

(54) WIRELESS HEADPHONE SYSTEM

(71) Applicant: Patent Holding i Nybro AB, Nybro (SE)

(72) Inventor: Bo Franzén, Nybro (SE)

(73) Assignee: PATENT HOLDING I NYBRO AB, Nybro (SE)

( * ) Notice: Subject to any disclaimer, the term of this patent is extended or adjusted under 35 U.S.C. 154(b) by 0 days.

(21) Appl. No.: 17/244,220

(22) Filed: Apr. 29, 2021

(65) Prior Publication Data

US 2021/0345032 A1 Nov. 4, 2021

(30) Foreign Application Priority Data

Apr. 30, 2020 (EP) ..... 20172250

(51) Int. Cl.
*H04R 1/10* (2006.01)
*H04R 1/08* (2006.01)

(52) U.S. Cl.
CPC ..... *H04R 1/1041* (2013.01); *H04R 1/08* (2013.01); *H04R 1/1008* (2013.01); *H04R 1/1016* (2013.01); *H04R 2420/07* (2013.01)

(58) Field of Classification Search
CPC ..... H04R 1/1041; H04R 1/08; H04R 1/1008; H04R 1/1016
See application file for complete search history.

(56) References Cited

U.S. PATENT DOCUMENTS

| | | | | |
|---|---|---|---|---|
| 9,497,530 | B1 * | 11/2016 | Campbell | H04R 29/001 |
| 10,575,106 | B1 * | 2/2020 | Bergmann | H04R 25/505 |
| 2013/0329905 | A1 * | 12/2013 | Awiszus | H04R 1/1058 455/39 |
| 2019/0045295 | A1 * | 2/2019 | Kim | H04R 1/1066 |
| 2019/0208050 | A1 * | 7/2019 | Gibbons | H04R 1/08 |
| 2020/0053451 | A1 * | 2/2020 | Unger | H04R 1/1083 |
| 2021/0044889 | A1 * | 2/2021 | Liu | G06F 3/165 |

* cited by examiner

*Primary Examiner* — Simon King
(74) *Attorney, Agent, or Firm* — Birch, Stewart, Kolasch & Birch, LLP

(57) ABSTRACT

A wireless headphone system is configured to be wirelessly coupled to a user equipment. The wireless headphone system includes at least one wireless ear-loudspeaker that can be attached to a person's ear. The at least one wireless ear-loudspeaker includes a power source and a transmitter and receiver module, and an external wireless microphone unit arranged independent of and unattached to the at least one wireless ear-loudspeaker. The external wireless microphone unit includes a power source, a transmitter- and receiver-module, at least one microphone and an attachment mechanism for attaching the external wireless microphone unit to a person.

8 Claims, 2 Drawing Sheets

WIRELESS HEADPHONE SYSTEM

TECHNICAL FIELD

The invention relates to the field of wireless earphone systems or wireless headphone systems, in particular Bluetooth or other types of wireless earphone systems using Wi-fi standards for transferring audio data.

BACKGROUND OF THE INVENTION

One problem with wireless headphone systems is that the microphone is integrated in one of the two headphones, typically on the side of the headphones that lies closest to the mouth of the person wearing the headphones. This means if the microphone is integrated in the left headphone, as seen from the view of the person wearing the headphones, then the microphone is arranged somewhere on the side of the left headphone that is directed towards the person's face. Typically, the location of the microphone is detectable by looking for a small hole, which is the sound channel for guiding the sound waves to the microphone that sits at an inner end of the sound channel. The problem is that the distance between a mouth of the person wearing the headphones and the microphone is rather large and wind, ambient noise and other disturbing sound effects have therewith a high impact on the quality of the sound that is transferred to the microphone.

In some cases a second microphone is arranged on the same headphone that comprises the first microphone that is directed towards the mouth of the person, as explained above. The second microphone is then typically arranged on the opposite side of the first microphone on the ear loudspeaker so that phase inversion can be performed in order to cancel out any constant ambient noise and filter out the voice of the person using the headphones. Some problems arise when this is done, one of them being that the ambient noise cancelling is not symmetric, since the microphones are normally only arranged on one of the headphones and thus on one side of the user's head. This means that ambient noise that is coming from the opposite side of the head of the person using the headphones, in the above example the right side (if the microphones are arranged on the left headphone), is difficult to detect and therewith cancel out. This may in particular be wind-noise but other noise or unwanted sound may affect such a noise cancelling. Another disadvantage is that the sound waves of the voice of the person or user do not enter the microphone directly but must travel a long distance, as explained above. In addition, the sound waves do not enter the sound channel, and therewith the microphone, in an orthogonal manner.

One may think that an easy fix for the above problems is to install two microphones on each of the headphones, thus in total four headphones per wireless headphone system in order to improve recorded sound/voice quality. This is however expensive and requires more energy of the in-built power source for calculation purposes.

SUMMARY OF THE INVENTION

An object of the present invention is to provide a wireless headphone system that has improved audio quality in particular for applications where the user or person using the wireless headphone system is interacting in some way with a third party, for example during a video call, a phone meeting or any other third party interaction.

In view of the above-mentioned problems the inventors of the present invention have discovered that it is possible to use an independent, external wireless microphone unit that can be coupled to the wireless headphone system and a user equipment. The user equipment may be a computer, a smartphone, a vehicle or any other sort of communication device. The external wireless microphone unit could therewith be positioned anywhere since it is not fixedly connected or integrally formed with any of the headphones or headphone system. Contrary to today's solutions the inventors therewith present a solution where a wireless headphone system comprises two independent parts, the wireless headphones or headset and the external wireless microphone unit, whereby the two independent parts can be connected wirelessly with one another and a user equipment.

Disclosed herein is a wireless headphone system configured to be wirelessly coupled to a user equipment. The wireless headphone system comprises:

- at least one wireless ear-loudspeaker that can be attached to a person's ear, for example the outer ear (over-ear headphones) or the ear-channel (ear buds) of a person, the at least one wireless ear-loudspeaker comprising a power source and a transmitter- and receiver module; and
- an external wireless microphone unit arranged independent of and unattached to the at least one wireless ear-loudspeaker comprising a power source and a transmitter- and receiver module. The external wireless microphone unit further comprises at least one microphone and an attachment mechanism for attaching the external wireless microphone unit to a person, the external wireless microphone unit being configured to be wirelessly connected to the at least one wireless ear-loudspeaker via the transmitter- and receiver-modules of the external wireless microphone unit and the at least one wireless ear-loudspeaker.

The external wireless microphone unit is a separate element.

The at least one ear-loudspeaker may further comprise an integrated processor for processing digital- and/or audio data. The processor may be integrated in the transmitter- and receiver module. Alternatively, the processor may be provided as a separate unit from the transmitter- and receiver module. Another alternative is to provide two processors in the at least one ear-loudspeaker, one integrated in the transmitter- and receiver module and one separate from the transmitter- and receiver module.

The external wireless microphone unit may further comprise an integrated processor for processing digital- and/or audio data. The processor may be integrated in the transmitter- and receiver module. Alternatively, the processor may be provided as a separate unit from the transmitter- and receiver module. Another alternative is to provide two processors in the external wireless microphone unit, one integrated in the transmitter- and receiver module and one separate from the transmitter- and receiver module.

The power source, the transmitter- and receiver module and optionally the processor(s) of the at least one wireless ear-loudspeaker are interconnected with one another and with the speaker or speakers of the at least one wireless ear-loudspeaker or the pair of ear-loudspeakers.

The power source, the transmitter- and receiver module and optionally the processor of the external wireless microphone unit are interconnected with one another and the microphone.

The at least one wireless ear-loudspeaker and the external wireless microphone unit are configured to send data packets and signals between each other and a user equipment for communication. The communication takes place in that the user equipment is coupled wirelessly to the external wireless microphone unit and the external wireless microphone unit is coupled wirelessly to the primary ear Jo loudspeaker and then the primary ear loudspeaker is coupled to the secondary ear loudspeaker, if such a secondary ear loudspeaker is present (optional). The primary and secondary ear loudspeakers are thereby virtually hardwired and synchronized even if they can be a pair of earbuds that are connected to one another in a wireless manner such as via Wi-fi or Bluetooth. The primary ear-loudspeaker is the at least one wireless ear-loudspeaker. The communication is thus formed like the number 7 with a middle line, whereby the bottom end is represented by the user equipment, the middle line by the external wireless microphone unit and the top end (secondary) and the top corner (primary) of the number 7 each represent the pair or at least one, of the ear loudspeakers. The voice audio recorded by the external wireless microphone unit is transmitted from the external wireless microphone unit to the user equipment.

An advantage of the above is that the external wireless microphone unit can also be used to serve more than one user, since it can be positioned in the middle between the more than one users so that all users can talk during a call.

The user equipment, the at least one ear-loudspeaker and the external wireless microphone unit are configured to transmit and receive data packages between one another in a wireless manner in order to establish communication or providing audio signals to each other.

The advantage of a wireless headphone system according to the above is that the external wireless microphone unit can be placed on the person or user so that the voice of the user can be optimally recognized and processed. With microphones that are integrated in the earphones or ear-loudspeakers, this is not the case. The position of the microphone versus the user's mouth is fixed and cannot be adjusted for optimal voice transmission.

The external wireless microphone unit may be equipped with a processor using a voice recognition algorithm that recognizes the user's voice and removes ambient noise for improved sound quality.

The external wireless microphone unit may comprise a loudspeaker that can replace the ear-loudspeakers. This may be beneficial if more than one user is taking part in a call and the use of earphones should be avoided.

In an embodiment the wireless headphone system may comprise a pair of wireless ear-loudspeakers.

The external wireless microphone unit maybe provided or sold as single piece of equipment that can be connected to existing, preferably wireless, earphone systems. In other words the external wireless microphone unit may be connected to and therewith sold as single piece of accessory that can be used with wireless devices, even with computers for a better voice quality when recording the voice of a person via a microphone.

A pair of ear-loudspeakers improves the user experience and sound quality.

The pair of wireless ear-loudspeakers may be over-ear headphones comprising a clip, which interconnects the pair of over-ear headphones.

Over-ear headphones are more comfortable for the user to wear but also bulkier.

Alternatively, the pair of wireless ear-loudspeakers may be earbuds. Each of the earbuds may comprise a transmitter- and receiver unit, a processor and power source so that the pair of earbuds can communicate with one another.

In an embodiment the external wireless microphone unit comprises at least two microphones.

Using two microphones allows to use phase-inversion for ambient noise cancelling. Phase-inversion also makes it possible to filter out the voice of the user.

In an embodiment the external wireless microphone unit may have a longitudinal shape and whereby one microphone is arranged at each end of the longitudinal shape.

The longitudinal shape allows for one of the two microphones to be arranged closer to the user's mouth so that the voice is easier recognized by the microphone closed to the mouth. This improves the result of the phase-inversion since the only sound wave that remains after the phase-inversion is the voice-soundwave profile of the user. The processor can then send the voice-soundwave information to the user equipment using the transmitter- and receiver module.

Preferably the longitudinal shape is arranged in parallel with the extension of the height of the user, thus, in case the user is standing on his/her feet, in parallel with the vertical direction.

In an embodiment the external wireless microphone unit may comprise at least one button for controlling the audio in the at least one ear-loudspeakers or even the user equipment via the external wireless microphone unit.

In some cases this improves the user experience, since the external wireless microphone unit can be used as a remote to, at least partially, control the user equipment and/or the at the least one wireless ear-loudspeaker.

In an embodiment the least one wireless ear-loudspeaker comprises an integrated microphone.

The integrated microphone may be used for calls when the user is not willing to or cannot use the external wireless microphone unit.

In an embodiment the external wireless microphone unit and the at least one ear-loudspeaker may be permanently paired, for instance via Bluetooth or Wi-fi.

This has the beneficial effect that it is easier for the user equipment to detect the wireless headphone system in the pairing mode when the user equipment searches for the wireless headphone system and vice versa.

The external wireless microphone unit may further be configured to wirelessly connect to the user equipment via the transmitter- and receiver module so that all communication to the at least one ear-loudspeaker or the pair of ear-loudspeakers goes via the external wireless microphone unit.

BRIEF DESCRIPTION OF THE DRAWINGS

The present invention will now be described, for exemplary purposes, in more detail by way of an embodiment(s) and with reference to the enclosed drawings, in which.

DETAILED DESCRIPTION

Figure 1:
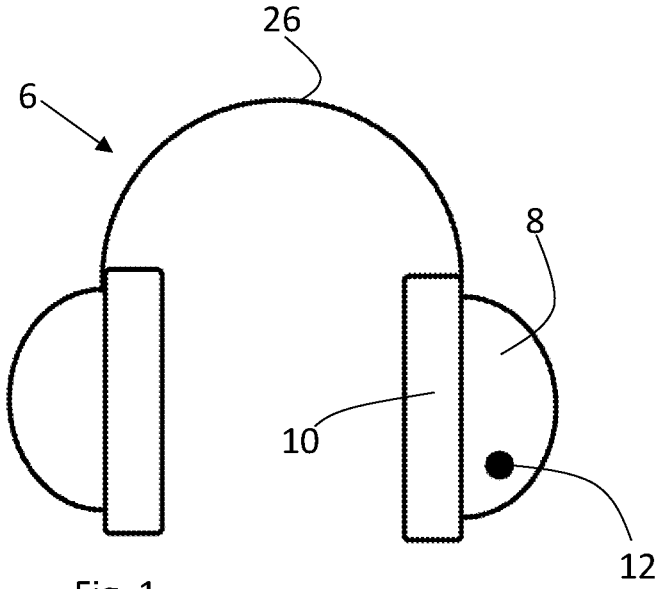
FIG. 1 schematically illustrates a pair of over-ear loudspeaker interconnected by a clip.

FIG. 1 illustrates a pair of wireless over-ear loudspeakers 6/over-ear headphones 6 having a microphone 12 and a transmitter- and receiver unit built in. The pair of wireless over-ear loudspeakers 6 are interconnected via a clip 26. The pair of wireless over-ear loudspeakers 6 further comprises an integrated processor and a transmitter- and receiver module. Each over-ear loudspeaker 6 comprises a bowl 8 and a ring-shaped or oval-shaped cushion 10. The processor and the transmitter- and receiver module may be arranged within the bowl 8 or alternatively in the clip 26 or one of them in the clip 26 and one of them in the bowl 8. The actual speaker is thereby embedded in the bowl 8 and the ring-shaped or oval-shaped cushion 10 is used to provide a comfortable experience to the user. In one of the over-ear loudspeakers 6, in particular in the bowl 8 of one of the over-ear loudspeakers 6, a microphone 12 is installed. This microphone 12 can be used Jo as normal wireless headset microphone 12, for example to make phone calls and recognize the voice of a person wearing the over-ear loudspeakers 6. Typically, the microphone 6 sits at the end of a sound channel arranged in the bowl for recording the user's voice.

The pair of over-ear loudspeakers 6 may be interconnected with one another via a cable or other type of connection that runs through the clip 26. The clip 26 may be called bow, yoke or strap.

Figure 2:
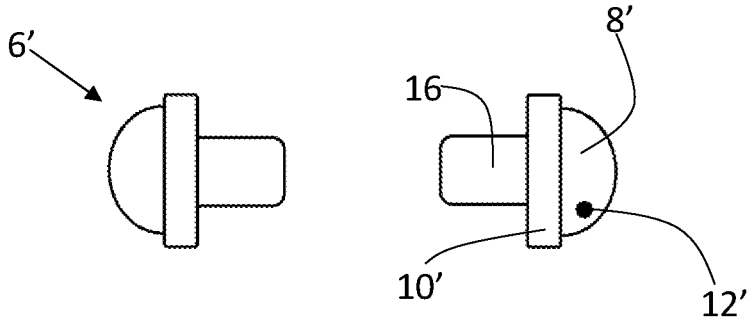
FIG. 2 schematically illustrates a pair of in-ear loudspeakers or earbuds.

FIG. 2 illustrates an alternative embodiment to FIG. 1, showing a pair of wireless in-ear loudspeakers or headphones 6'. As described above the pair of in-ear loudspeakers 6' each comprise a transmitter- and receiver module. In addition at least one of the pair of in-ear loudspeakers 6' comprises a processor and a microphone 12'. As illustrated in connection with FIG. 1, each of the in-ear loudspeakers 6' comprises a cushion 10' made of flexible material for instance rubber in order to improve comfort, resistance of falling out and in order to soundproof the auditory channel of a user's ear. The in-ear loudspeakers 6' further comprise an extension 16 that is configured to extend into the auditory channel of a user's ear when the pair of in-ear loudspeakers 6' are worn. The extension 16 guides the soundwaves closer to the eardrum of the user. One of the in-ear loudspeakers 6' comprises a microphone 12' in order to provide the ability of recognizing and transmitting the user's voice.

It is clear that in the above described FIGS. 1 and 2 it is possible to only use one of the illustrated ear loudspeakers. In case of the over-ear loudspeakers 6, this one my be held in place by using a clip or a bow as it is known from telephone headsets that are connected to the telephone via cable.

The processor is connected to the transmitter- and receiver module for electric communication.

Figure 3:
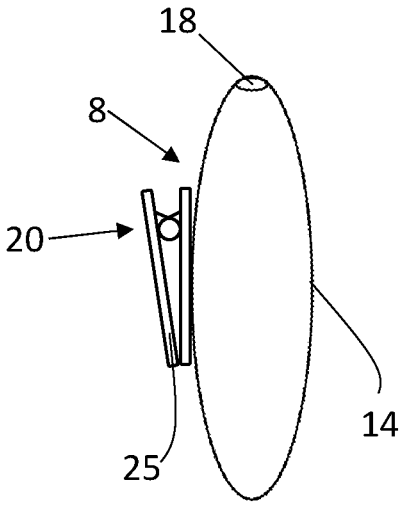
FIG. 3 schematically illustrates a first embodiment of an external wireless microphone unit having one microphone.
Figure 4:
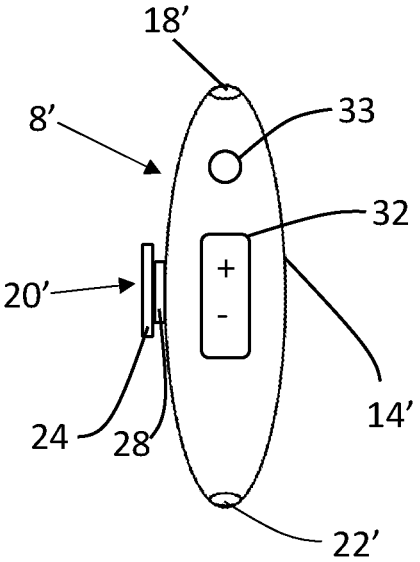
FIG. 4 schematically illustrates a second embodiment of an external wireless microphone unit having two microphones.
Figure 5:
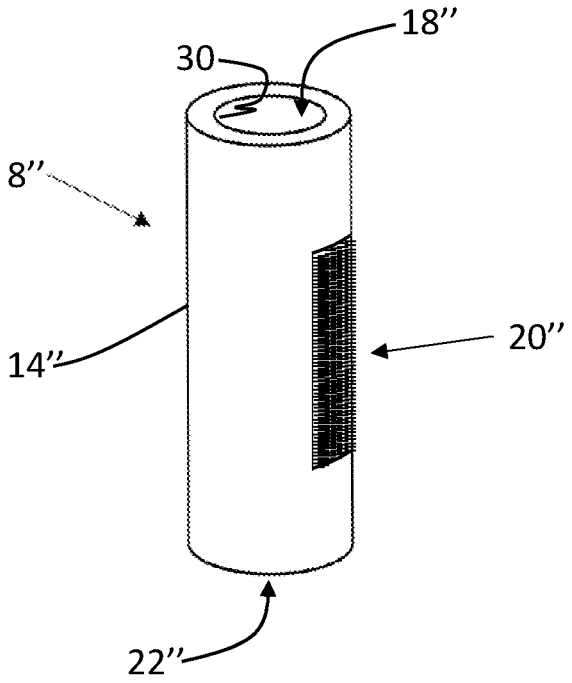
FIG. 5 schematically illustrates a third embodiment of an external wireless microphone unit.

The microphones 12, 12' illustrated in connection with FIGS. 1 and 2 are optional, since the pair of over-ear loudspeakers 6 or the pair of in-ear loudspeakers 6' can be used together with any of the external wireless microphone unit 8, as illustrated in FIGS. 3 to 5.

FIG. 3 illustrates an external wireless microphone unit 8 comprising a casing 14 and an upper microphone 18. The external wireless microphone unit 8 has a longitudinal shape corresponding to a longitudinal elliptic shape. The upper microphone is arranged so that it sits well protected within the casing 14 and in that a sound channel is formed in the casing 14 so that the acoustic waves or sound waves can reach the upper microphone 18. The external wireless microphone unit 8 further comprises a transmitter- and receiver-module and a processor. The transmitter- and receiver module is configured to receive and send data via Bluetooth, Wi-Fi protocol or any other suitable wireless communication channel. The processor is connected to the transmitter- and receiver module for electric communication. In addition, the processor is configured to provide a voice recognition algorithm for filtering the voice of the user from ambient noise. The embodiment of the external wireless microphone unit 8 illustrated in FIG. 3 further comprises an attachment mechanism 20 in the form of a clamp/clip 25 that can be fastened to cloth of a user, for example the collar of a pullover, jacket, shirt or T-shirt. This way the upper microphone 18 is arranged rather close to the mouth and therewith the sound-source of the user for optimal recognition of the voice of the user. The external wireless microphone unit 8 is totally independent and not attached to the pair of wireless ear loudspeakers, as illustrated in FIGS. 1 and 2. It is a freestanding unit that together with at least one ear-loudspeaker 6, 6' forms a wireless headphone system.

FIG. 4 illustrates another embodiment of an external wireless microphone unit 8' comprising an upper microphone 18' and a lower microphone 22'. The attachment mechanism 20' is also illustrated, this time in the form of a magnetic attachment mechanism with two magnets 24, 28, and the external wireless microphone unit 8' has a similar longitudinal shape as the one illustrated in FIG. 3. The two magnets of the attachment mechanism 20' work as a clamping tool whereby the outer magnet 24 can be arranged on one side of a cloth and the inner magnet 28, which is fixedly connected to the casing 14' of the external wireless microphone unit 8', on another side of the cloth of the user for clamping the external wireless Jo microphone unit 8' to the cloth of the user. The upper microphone 18' again be arranged closer to the mouth of the user as the lower microphone 22' so that phase inversion can be applied. The positions of the two microphones 18',22' can of course be switched so that the lower microphone 22' is arranged closer to the human mouth than the upper microphone 18', this does not harm the functionality of the phase inversion. Again the external wireless microphone unit 8' is totally independent and not attached to the pair of wireless ear loudspeakers, as illustrated in FIGS. 1 and 2. It is a freestanding unit that together with at least one ear-loudspeaker 6, 6' forms a wireless headphone system.

FIG. 4 further illustrates buttons 32 arranged on the casing 14' to control the volume in the wireless ear-loudspeakers. Another button 33 may be used for receiving calls, pause music, etc.

FIG. 5 still illustrates another embodiment of an external wireless microphone unit 8". The external wireless microphone unit 8" comprises also an upper microphone 18" and a lower microphone 22" as explained referring to FIGS. 3 and 4. The shape of the external wireless microphone unit 8" as shown in FIG. 5 is also longitudinal and cylindric. The upper microphone 18" and the lower microphone 22" are arranged within the housing 14" at the end of a sound channel 30 that is formed in the housing 14". FIG. 5 further illustrates another solution for the attachment mechanism 20" in the form of a hook and loop fastening, whereby the attachment mechanism 20" contains a pad with hooks of a Velcro system so that the hooks can engage loops (fabric) in the cloth of a user. The pad may be connected to the casing 14" via a type or the like, even a magnetic solution is possible. Once again the external wireless microphone unit 8" shown in FIG. 5 is totally independent and not attached to the pair of wireless ear loudspeakers, as illustrated in FIGS. 1 and 2. It is a freestanding unit that together with at least one ear-loudspeaker 6, 6' forms a wireless headphone system.

The sound channel 30 as shown in FIG. 5 is also possible to be used in connection with the embodiments illustrated in FIGS. 3 and 4.

In addition, the different attachment mechanism 20, 20', 20" illustrated in FIGS. 3 to 5 can of course be used with any of the external wireless microphone units 8, 8',8".

Further, any of the embodiments shown in FIGS. 3 to 5 may be used with only an upper microphone 18, 18',18" and no lower microphone 20',20".

Additionally, the buttons 32, 33 may also be installed on any of the embodiments shown in FIGS. 3 and 5. Any of the buttons 32, 33 may be omitted or not used. In other words, the button 32 may be installed on any of the external wireless microphone unit 8, 8',8" without the other button 33. Alternatively, the button 33 for receiving calls and pausing music may be installed independent of the button 32 for controlling the volume.

The wireless headphone system may be sold together with a power bank or the like for charging the power sources in the ear-loudspeakers and/or the power sources in the external wireless microphone units 8, 8',8".

The power source integrated in the ear-loudspeakers 6, 6' may be an integrated accumulator that can be recharged, or it may be a battery that can be replaced or a battery that can be recharged.

The same can be said for the power source integrated in the external wireless microphone unit 8, 8',8". The power source may be an integrated accumulator that can be recharged, or it may be a battery that can be replaced or a battery that can be recharged.

In addition to the above any of the described embodiments of the external wireless microphone unit 8, 8',8" or combination thereof can instead of the attachment mechanism 20, 20',20" comprise a necklace connected to the external wireless microphone unit 8, 8',8". This way the external wireless microphone unit 8, 8',8" becomes an accessory that can be worn around the neck of a person/user. The external wireless microphone unit 8, 8',8" may be designed accordingly.

The term attachment mechanism 20, 20',20" in the above description herewith Jo also covers a necklace connected to the external wireless microphone unit 8, 8',8".

The invention claimed is:

1. A wireless headphone system configured to be wirelessly coupled to a user equipment, the wireless headphone system comprising:

at least one wireless ear-loudspeaker that can be attached to a person's ear, the at least one wireless ear-loudspeaker comprising a power source and a transmitter and receiver module; and an external wireless microphone unit arranged independent of and unattached to the at least one wireless ear-loudspeaker, wherein the external wireless microphone unit comprises a power source, a transmitter-and receiver-module, at least one microphone and an attachment mechanism for attaching the external wireless microphone unit to a person, the external wireless microphone unit being configured to be wirelessly connected to the at least one wireless ear-loudspeaker via the transmitter- and receiver-module of the external wireless microphone unit and the at least one wireless ear-loudspeaker, and wherein the external wireless microphone unit comprises two microphones and wherein the external wireless microphone unit has a longitudinal shape and whereby one microphone is arranged at each end of the longitudinal shape.

2. The wireless headphone system according to claim 1, comprising a pair of wireless ear-loudspeakers.

3. The wireless headphone system according to claim 2, wherein the pair of wireless ear-loudspeakers are over-ear headphones comprising a clip, the clip interconnecting the pair of over-ear headphones.

4. The wireless headphone system according to claim 2, wherein the pair of wireless ear-loudspeakers are earbuds.

5. The wireless headphone system according to claim 1, wherein the external wireless microphone unit comprises at least one button for controlling the audio via the external wireless microphone unit.

6. The wireless headphone system according to claim 1, wherein at least one wireless ear-loudspeaker comprises an integrated microphone.

7. The wireless headphone system according to claim 1, wherein the external wireless microphone unit and the at least one ear-loudspeaker are permanently paired.

8. The wireless headphone system according to claim 1, wherein the external wireless microphone unit is further configured to be wirelessly connected to the user equipment via the transmitter- and receiver module.

* * * * *